US006586045B1

(12) United States Patent
Cole

(10) Patent No.: US 6,586,045 B1
(45) Date of Patent: Jul. 1, 2003

(54) METHOD FOR PRODUCING A PATTERN ON FABRIC

(76) Inventor: Hilary Platt Cole, 66 Chebacco Rd., South Hamilton, MA (US) 01982

( * ) Notice: Subject to any disclaimer, the term of this patent is extended or adjusted under 35 U.S.C. 154(b) by 0 days.

(21) Appl. No.: 09/556,712

(22) Filed: Apr. 24, 2000

Related U.S. Application Data

(60) Provisional application No. 60/131,299, filed on Apr. 27, 1999.

(51) Int. Cl.[7] ..... B05D 5/06

(52) U.S. Cl. ..... 427/171; 427/260; 427/262; 427/267; 427/273; 427/280; 427/288; 427/377; 427/421; 427/429; 8/479; 8/483; 8/485; 8/637.1; 8/158

(58) Field of Search ..... 427/346, 171, 427/172, 176, 377, 429, 421, 280, 288, 260, 262, 267, 273; 118/56; 8/479, 158, 480, 483, 485, 637.1, 159

(56) References Cited

U.S. PATENT DOCUMENTS

| | | | | | |
|---|---|---|---|---|---|
| 1,202,652 | A | * | 10/1916 | Bentley | 8/484 |
| 3,632,380 | A | * | 1/1972 | Caroselli et al. | 117/37 |
| 3,717,500 | A | * | 2/1973 | Mastrianni | 117/76 |
| 3,744,967 | A | * | 7/1973 | Thackrah | 8/54.2 |
| 3,762,872 | A | * | 10/1973 | Acree | 8/176 |
| 4,104,893 | A | * | 8/1978 | Marchesini et al. | 68/202 |
| 4,108,595 | A | * | 8/1978 | Pappas | 8/149 |
| 4,822,376 | A | * | 4/1989 | Tucci | 8/478 |
| 5,066,535 | A | * | 11/1991 | Christie | 427/273 |
| 5,082,468 | A | * | 1/1992 | Hopkins | 8/477 |
| 5,554,198 | A | * | 9/1996 | Poplin | 8/482 |

OTHER PUBLICATIONS

Hawley's Condensed Chemical Dictionary, 12th ed., p. 301, 1993.*

Wauchope, Silk Painting Step–by–Step: A Guide to Techniques and Materials, 1993, pp. 54, 58, and 59.*

Hawley's Condensed Chemical Dictionary, 12$^{th}$ edition, 1993, p. 866.*

* cited by examiner

*Primary Examiner*—Shrive P. Beck
*Assistant Examiner*—Kirsten C. Jolley
(74) *Attorney, Agent, or Firm*—O'Connell Law Firm

(57) ABSTRACT

A method for creating a pattern by applying varying concentrations of pigment in water to a synthetic fabric and allowing the pigment to bleed and preferably to reverse bleed. A pleated window shade having an Aurora Borealis like pattern is also provided. The preferred method comprises the steps of stretching a pleated synthetic fabric window shade vertically, applying pigment in water to the surface of the fabric and allowing the pigment to bleed, then inverting the fabric so that the pigment in solvent bleeds in the opposite direction. Optionally, the method further includes at least one of the steps of applying the solvent, such as for example water, to the pigmented surface before inverting or after inverting thereby inducing additional bleeding, blending, and dilution of the pigment in the wetted area.

11 Claims, 2 Drawing Sheets

(2 of 2 Drawing Sheet(s) Filed in Color)

METHOD FOR PRODUCING A PATTERN ON FABRIC

This application claims the benefit of U.S. Provisional Patent Application Ser. No. 60/131,299 filed Apr. 27, 1999 entitled "A Method of Producing a Pattern on a Fabric and the Product Made Thereby", the entirety contents of which are hereby incorporated by reference.

FIELD OF THE INVENTION

The present invention provides a method for producing a pattern on a fabric and a device so patterned. More specifically, the invention provides a method for creating an abstract pattern on a semi-absorbent fabric using pigment and solvent that results in distribution of at least one pigment at variable pigment densities per unit area of the fabric. The method is useful, for example, for producing a pattern on an accordion pleated shade for a window.

BACKGROUND OF THE INVENTION

The amount of light and quality of light that enters a room through a window can affect the activities that occur in a room as well as the mood of the people in the room. In some instances, it is desirable to be able to look outside through a glass window. Occasionally, the sunlight may be intense enough to cause glare, which may result in eye strain and headaches in those in the room. To avoid this and other hazards of direct sunlight as well as for decorative reasons, window treatments such as shades and blinds have been used.

The amount of light and the quality, such as for example the color, of the light that is permitted to enter a room through a window can affect the environment or perceived environment of the room. Certain colors, such as for example blues, are thought to suggest a feeling of coolness to a person sitting in a room. Other colors such as for example orange, are thought to suggest warmth. Intense sunlight in a room can result in an increase in the temperature of the room. However, a darkened room may the use of electricity for lights. Thus, it is desirable to be able to make use of the natural light, but to be able to have the ability to adjust its intensity and quality.

SUMMARY OF THE INVENTION

The present invention provides a method for producing a pattern on a fabric comprising the steps of: providing a semi-absorbent woven fabric having a top first edge and a bottom second edge; applying at least one pigment having a pigment concentration in fabric permeating amount of solvent, such as for example water, to the fabric in a region substantially parallel to the top edge of the fabric; optionally applying a solvent to the region substantially parallel to the top edge; and rotating the fabric so that the top first edge is at the bottom and the bottom second edge is at the top. When the fabric is rotated, the extra solvent picks up pigment and carries it toward the lower edge of the fabric. The amount of flow is determined by the amount of solvent per unit area. When the solvent is absorbed or "entrapped" in the spaces between the woven threads, some of the pigment is retained in that area as the solvent evaporates. Thus, a pattern is created.

In the preferred embodiment of the method, the pigment in solvent is capable of completely permeating and penetrating the region of fabric to which it is applied so that both sides of the fabric become completely colored with pigment in an abstract pattern after the solvent has evaporated. The composition of the fabric, the density of the weave of the fabric, and the texture can be varied to achieve an appropriate semi-absorbent fabric. A preferred fabric has a linen like texture, a closed weave, and a composition of polyester and rayon. However, when pattern consistency on both sides of the fabric is not necessary, any fabric having a composition and weave capable of entrapping and thus localizing the pigment in solvent until the solvent evaporates may be used.

When a pattern is made on a pleated window shade fabric comprising polyester and rayon by the inventive method, a device that allows an occupant of a room to alter the intensity and quality of the light entering the room through the window is created. Preferably, the light is natural light. In an embodiment of a fabric window treatment, such as for example a pleated window shade, the shade is suspended vertically, so that there is a top edge of the window treatment and an opposing bottom edge of the window treatment. A pigment having a hue or color is suspended in a solvent, such as for example water, at a concentration. A plurality of pigment concentrations and a plurality of pigment hues may be used on each window treatment. A first pigment suspension having a first concentration and a first hue is applied preferably using for example a synthetic brush having a width. Preferably, the pigment suspension is applied in a line along the horizontal axis of the pleated shade, substantially parallel to the top of the window treatment. Next, a second application of a second pigment having a second concentration and a second hue is made substantially along the horizontal axis of the window treatment The second application may overlap the first application by up to 99%. Each pigment in solvent penetrates the fabric to form a band substantially equal in size and having substantially an equal concentration of pigment as that provided on the side of the fabric to which the pigment in solvent was applied. Preferably, the second application overlaps the first application by less than 25%. Where the applications overlap, the pigment density (concentration) is greater than in areas of no overlap. Further, the amount of solvent present is higher in areas of overlap. Next, the window treatment bottom edge and the window treatment top edge are reversed so that the window treatment hangs upside down. Due to the variable amounts of solvent and pigment, a variable pattern is created as the pigment in solvent that remains unabsorbed flows on the fabric.

In a first alternative embodiment of the method, prior to hanging the window treatment upside down, the window treatment is sprayed with solvent in selected areas on only one side of the fabric. The solvent preferably is the same as the solvent in which the pigment was suspended In a second alternative embodiment, before the window treatment is hung upside down, selected areas are sprayed with solvent. In a third alternative embodiment, after the window treatment is hung upside down, selected areas are sprayed with solvent before and after turning the fabric. In each case, a variable amount of pigment on the fabric is picked up by the solvent and carried on the fabric. Depending upon the absorbency of the fabric, variable pigment densities are achieved. As the solvent evaporates, areas having differential pigment concentrations form an abstract pattern having light and dark areas which may be translucent.

BRIEF DESCRIPTION OF THE DRAWINGS

The claim of the patent contains at least one drawing executed in color.

DETAILED DESCRIPTION OF THE INVENTION

Figure 1:
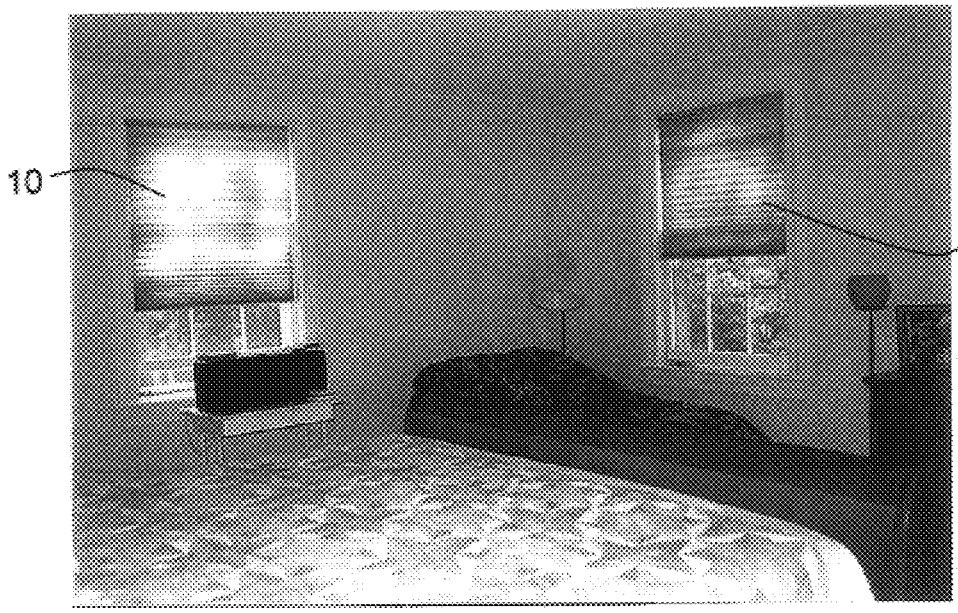
FIG. 1 is a photograph of a room having two windows wherein one inventive translucent window treatment is hung at each window.

A window treatment of the pleated type having a pattern defined by pigments of at least one hue and disposed on the pleated window treatment in varying concentrations and a method of making that window treatment are provided. The method provides a translucent pattern resembling an Aurora Borealis pattern on semi-absorbent fabric. When a sheer fabric is used, the pattern has a translucent quality. It should be apparent to those skilled in the art that the process used to achieve the pattern could be used with other fabric products where the absorption and retention properties of the fabric are similar to those described herein. For example, a fabric room divider where the fabric is held in a frame may be patterned by this process.

An opaque pleated window shade comprising polyester fabric that is tightly woven (closed weave) was manufactured by Cooper/Kirsch and was obtained from J. C. Penny, Inc.(Dallas, Tex.) for making opaque pleated patterned window shades. Alternatively, sheer pleated window shades manufactured by Cooper/Kirsch such as consist of 65% polyester and 35% rayon were obtained from J. C. Penny, Inc. (Dallas, Tex.). Preferably, the window shade fabric has a linen-like or linen-like nap look to it.

The pleated window shade has a top edge and an opposing bottom edge that is parallel to the top edge. While the pattern was being formed, the pleated window shade was hung in an area receiving indirect or artificial light or where the fabric remains at about room temperature to deter rapid drying of a solvent. The pleated shade was fully extended so that each pleat was stretched open, maximizing the distance between the top and the bottom edges.

Pigments of a variety of hues such as purples, reds, blues, greens, browns, yellows, grays and blacks were prepared in a solvent at desired pigment concentrations. For example, Deka-Permanent Fabric Paint (Deka, Inc.; Vermont) available from an art supply store was used as the pigment and water was used as the solvent. These fabric paints are inks comprising water soluble pigments. A typical ink comprises 5% ink pigment in water. Preferably, the ink chosen is water-soluble, non-fading, and non-toxic. For use in the inventive method, the fabric paint may be further diluted with water up to about 50 times before application to the pleated window shade.

A pigment of the desired hue at the desired concentration was directly applied to the shade starting proximal to the top of the pleated window shade, preferably using for example a five inch synthetic brush. The pigment solution or suspension was applied in sufficient quantity that the fabric of the pleated window shade is unable to immediately absorb all the applied solvent which in this example was water. Before the first application of pigment was absorbed, additional applications of pigment in solvent were applied in regions substantially parallel to the preceding application, until the entire surface of the suspended pleated window shade was coated. The pleated window shade was then inverted and was suspended by its bottom edge, so that the solvent which was yet to be fully absorbed by the fabric bled toward the inverted top edge, blending hues and altering the density of pigment or pigments at locations on the fabric. In an alternative embodiment, selected areas of the surface of the fabric may be sprayed with solvent prior to inverting the shade. In a second alternative embodiment after inverting and suspending the pleated fabric window shade, the pigmented surface was sprayed with water in selected locations to reduce the density of the pigment(s) in the area directly sprayed.

Referring now to FIG. 1, a pair of pleated fabric window shades 10 and 20 each having a pattern produced by the following method are shown. A sheer one inch pleated shade made of light filtering linen-look off-white material comprising 65% polyester and 35% rayon was obtained from J. C. Penny, Inc. Blue Deka-permanent fabric paint was obtained from an art supply store. The pleated shade was hung vertically and stretched. Starting at the top or first edge of the shade and working towards the bottom or second of the shade, blue pigment was applied with a five inch wide nylon brush to selected areas of the shade in bands that were substantially parallel to the first and second edges. In some areas, the bands were made to overlap so that regions of increased pigment density were created. When the brush started to dry, it was washed with water and then used to blend areas where pigment had been applied or it was dipped in the blue fabric paint to re-ink it for further application of ink to new areas of the shade. More solvent was provided than could be immediately absorbed by the pleated shade, thus the areas bled into one another. Next, the pleated shade was inverted and the bleeding was reversed resulting in a uniform bleed across the surface. Selected areas of the shade were sprayed with solvent after the shade was inverted. Preferably, the method described is practiced in a lowly light or indirectly light environment to slow the drying process. This may also be facilitated by producing the pattern in an area where the humid is at least about 75% to 95%. An abstract blue pattern having areas of translucence is seen on each shade in FIG. 1.

Figure 2:
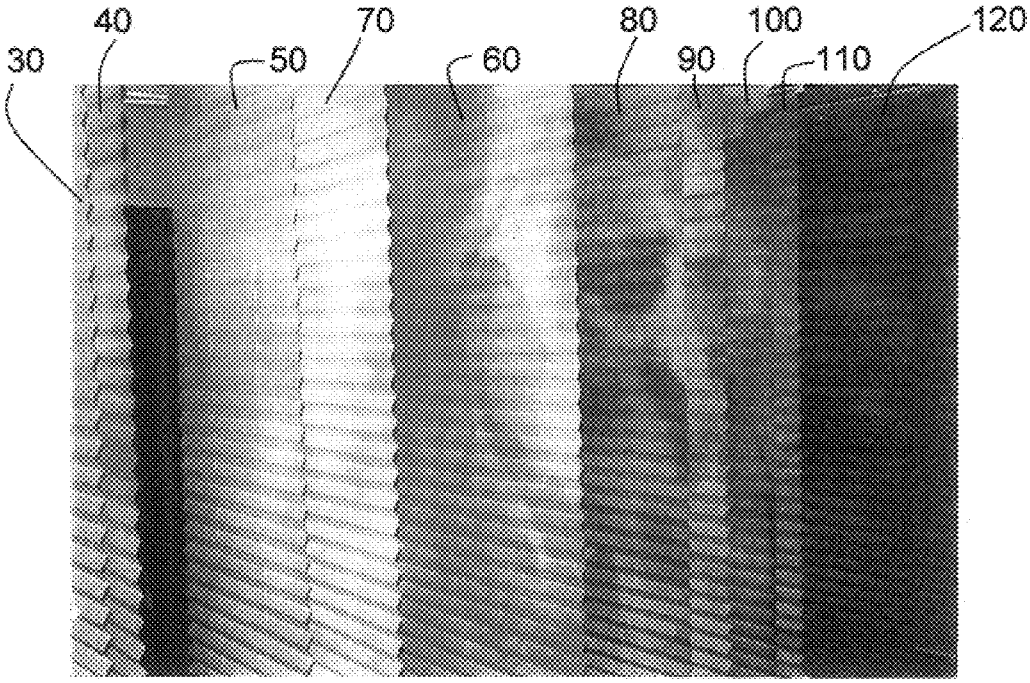
FIG. 2 is a photograph of a plurality of the inventive window treatments where one treatment vertically hangs next to another illustrating the Aurora Borealis like patterns achieved by the invention method.

Referring now to FIG. 2, pleated fabric window shades made using a plurality of hues of pigments are illustrated. Pleated fabric window shade 60 is patterned with red pigment and yellow pigment. Varying dilution's of a 5% red ink pigment in water and of a 5% yellow ink pigment in water were made prior to applying any pigment to the surface of the pleated fabric window shade. A sheer one inch pleated shade made of light filtering linen-look material comprising 65% -polyester and 35% rayon obtained from J. C. Penny, Inc. was hung vertically and was stretched longitudinally to substantially straighten the pleats and smooth the fabric. Starting at the top of the sheer pleated shade, red pigment was applied using a five inch synthetic paint brush. The brush was then rinsed with water and dipped into the diluted yellow pigment which was then applied partially over the freshly applied red pigmented area and partially over the off-white unpigmented area of the shade. Next, the brush was washed with water and water was applied to areas pigmented yellow, lightening those areas and causing pigment and water to bleed down the shade. Additional pigment of either red or yellow of varying concentrations was applied to the middle region of the shade then to the lower region of the shade. Water was occasionally brushed over pigmented areas to blend the combined pigments and to induce bleeding.

As described above, other methods of applying solvent such as for example, a sprayer that creates a mist such as used to mist plants can be used. After the lower region of the shade was pigmented, the shade was inverted so that the shade was hung vertically from the lower region (its bottom edge) to induce reverse bleeding. When more translucent areas were desired on the shade, the shade was sprayed with a hand sprayer containing water particularly after inversion. Again, other methods for application of solvent can be used such as for example flicking water at the fabric from a water-laden brush. As can be seen from window shade 60, an aurora borealis-like pattern is achieved.

FIG. 2 illustrates window shades 30, 40, 50, 70, 80, 90, 100, 110, and 120 which were patterned using a method similar to that described above while varying the pigment hues, pigment placement, and pigment density.

Figure 3:
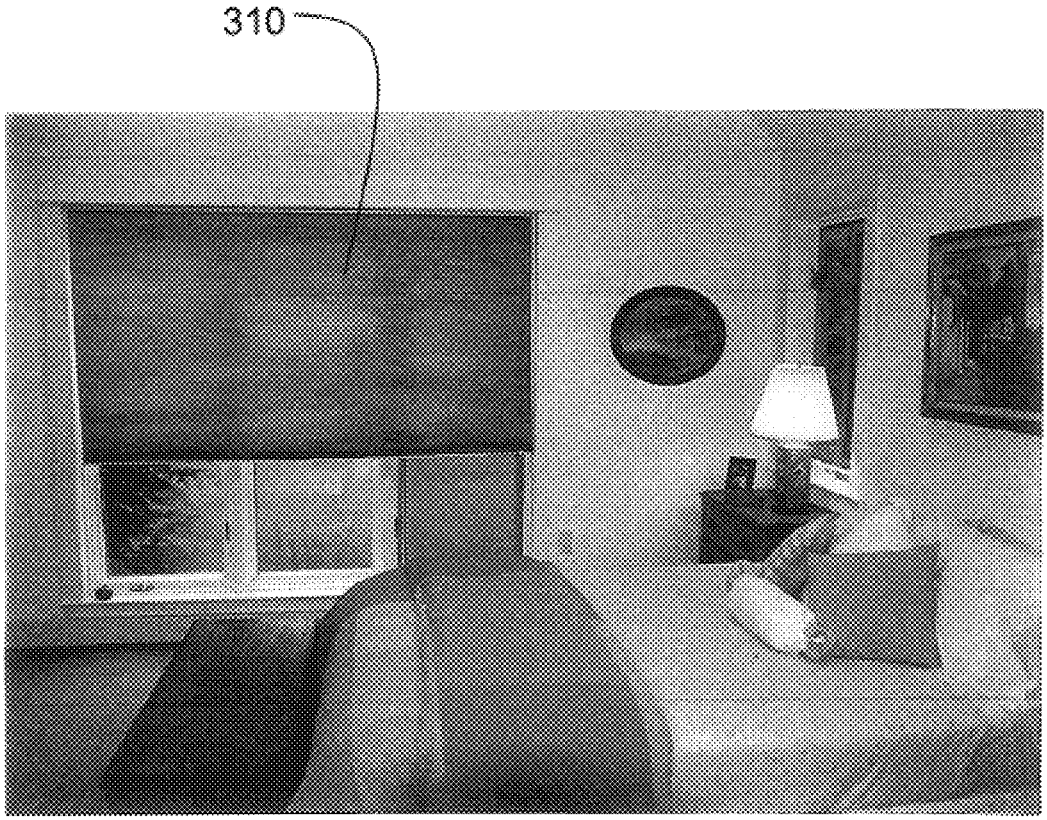
FIG. 3 is a color photograph of a room having a window wherein one inventive opaque window treatment is hung at the window.

FIG. 3 shows the front surface of an opaque polyester pleated window shade 310 that has been made using two pigments, blue and green. The pigments were applied in solvent in separate regions, blended, and water was brushed on. The window shade was then inverted and allowed to dry.

Modifications and variations can be made to the disclosed embodiments without departing from the subject and spirit of the invention as defined in the following claims. Such modifications and variations, as included within the scope of these claims, are meant to be considered part of the invention as described.

What is claimed is:

1. A method of creating a pattern on a fabric under a batch process comprising the steps of:

providing a length of fabric;

stretching the fabric longitudinally so that the fabric has an upper region, a middle region, and a lower region, with the length of fabric in a stationary condition, applying at least one piglet in a composition with a solvent to the upper region wherein the solvent is applied in a sufficiently extra quantity that the fabric is unable to absorb the solvent immediately;

with the length of fabric in a stationary condition, applying at least one pigment in a composition with a solvent to the middle region and to the lower region before the solvent in the upper region is absorbed wherein the pigment in the composition with the solvent is applied to the middle region and to the lower region to overlap only partial with the pigment in the composition with the solvent applied to the upper region;

inverting the fabric so that the upper region is positioned below the lower region;

applying additional solvent to the upper region before inverting the fabric; and allowing the composition to dry on the fabric at approximately room temperature.

2. The method of claim 1 further comprising the step of suspending the fabric in an area having a humidity of from about 75% to about 95%.

3. The method of claim 1 wherein a brush having synthetic bristles is used to apply the pigment manually.

4. The method of claim 1 wherein the pigment has a concentration in the composition with the solvent of from about 0.005% to about 10.000% by volume.

5. The method of claim 4 wherein the pigment has concentration in the composition with the solvent from about 0.1% to about 5.0% by volume.

6. The method of claim 1 wherein the additional solvent is brushed onto the fabric.

7. A method of creating a pattern on a fabric under a batch process comprising the steps of:

providing a length of fabric;

stretching the fabric longitudinally so that the fabric has an upper region, a middle region, and a lower region, with the length of fabric in a stationary condition, applying at least one pigment in a composition with a solvent to the upper region wherein the solvent is applied in a sufficiently extra quantity that the fabric is unable to absorb the solvent immediately;

with the length of fabric in a stationary condition, applying at least one pigment in a composition with a solvent to the middle region and to the lower region before the solvent in the upper region is absorbed wherein the pigment in the composition with the solvent is applied to the middle region and to the lower region to overlap only partially with the pigment in the composition with the solvent applied to the upper region;

inverting the fabric so that the upper region is positioned below the lower region;

applying additional solvent to the upper region after inverting the fabric; and allowing the composition to dry on the fabric at approximately room temperature.

8. The method of claim 7 wherein the additional solvent is sprayed onto the fabric in localized regions.

9. The method of claim 7 wherein the fabric has a linen texture.

10. The method of claim 9 wherein the fabric comprises a polyester.

11. The method of claim 10 wherein the fabric comprises approximately 65% polyester and approximately 35% nylon.

* * * * *